US011480022B2

(12) United States Patent
Jones

(10) Patent No.: US 11,480,022 B2
(45) **Date of Patent: *Oct. 25, 2022**

(54) VARIABLE INTENSITY AND SELECTIVE PRESSURE ACTIVATED JAR

(71) Applicant: HydraShock, L.L.C., Clinton, OK (US)

(72) Inventor: Kevin Dewayne Jones, Clinton, OK (US)

(73) Assignee: HydraShock, L.L.C., Clinton, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/380,017

(22) Filed: Apr. 10, 2019

(65) Prior Publication Data

US 2019/0234165 A1 Aug. 1, 2019

Related U.S. Application Data

(63) Continuation of application No. 15/443,070, filed on Feb. 27, 2017, now Pat. No. 10,267,114.

(Continued)

(51) Int. Cl.

| | |
|---|---|
| ***E21B 31/113*** | (2006.01) |
| ***E21B 23/04*** | (2006.01) |
| ***E21B 23/10*** | (2006.01) |

(52) U.S. Cl.

CPC ..... *E21B 31/113* (2013.01); *E21B 23/04* (2013.01); *E21B 23/10* (2013.01)

(58) Field of Classification Search

CPC ..... E21B 23/04; E21B 23/10; E21B 31/113

See application file for complete search history.

(56) References Cited

U.S. PATENT DOCUMENTS

| | | | |
|---|---|---|---|
| 3,020,964 | A | 2/1962 | Graham et al. |
| 3,535,056 | A | 10/1970 | Harbison |

(Continued)

FOREIGN PATENT DOCUMENTS

| | | | |
|---|---|---|---|
| RU | 166931 | U1 | 12/2016 |
| WO | 2008146012 | A2 | 12/2008 |
| WO | 2013175189 | A2 | 11/2013 |

OTHER PUBLICATIONS

Korean Intellectual Property Office, "Patent Cooperation Treaty PCT International Search Report", dated Jun. 9, 2017, 3 pages, Republic of Korea.

(Continued)

*Primary Examiner* — Caroline N Butcher

(74) *Attorney, Agent, or Firm* — Tomlinson McKinstry, P.C.

(57) ABSTRACT

A jarring tool used to dislodge a stuck tubular string or bottom hole assembly within an underground wellbore. Tubular strings with which the tool may be used may be formed from drill pipe, jointed pipe, or coiled tubing. A funnel element is placed underground either within, or as part of, a tubular string. A deformable ball may be seated within the funnel element to block fluid from passing within the tubular string. Hydraulic pressure may build within the tubular string until it exceeds the pressure the ball can withstand. This will cause the ball to deform and be expelled through the funnel element. With no ball to block its flow, fluid will be rapidly released through the funnel element. The rapid release of fluid will cause a powerful jarring or jolting to the tubular string or bottom hole assembly.

18 Claims, 20 Drawing Sheets

Related U.S. Application Data

(60) Provisional application No. 62/301,398, filed on Feb. 29, 2016.

(56) References Cited

U.S. PATENT DOCUMENTS

| | | | | |
|---|---|---|---|---|
| 4,341,272 | A | 7/1982 | Marshall | |
| 4,889,199 | A | 12/1989 | Lee | |
| 5,797,454 | A * | 8/1998 | Hipp | E21B 17/06 166/196 |
| 6,182,775 | B1 | 2/2001 | Hipp | |
| 6,290,004 | B1 | 9/2001 | Evans | |
| 6,318,470 | B1 | 11/2001 | Chang et al. | |
| 6,681,860 | B1 | 1/2004 | Yokley et al. | |
| 6,923,255 | B2 | 8/2005 | Lee | |
| 8,297,365 | B2 | 10/2012 | Dove | |
| 8,365,818 | B2 | 2/2013 | Schultz et al. | |
| 8,561,688 | B2 | 10/2013 | Evans | |
| 9,228,402 | B2 | 1/2016 | Strilchuk | |
| 2009/0166026 | A1 | 7/2009 | Akselberg | |
| 2009/0283322 | A1 * | 11/2009 | Dove | E21B 17/06 175/40 |
| 2014/0060854 | A1 | 3/2014 | Baudoin | |
| 2015/0136416 | A1 | 5/2015 | Churchill | |
| 2015/0226031 | A1 * | 8/2015 | Hekelaar | E21B 34/14 166/298 |

OTHER PUBLICATIONS

Korean Intellectual Property Office, "Patent Cooperation Treaty PCT Written Opinion of the International Searching Authority", dated Jun. 9, 2017, 15 pages, Republic of Korea.

International Bureau, "International Application Status Report", dated May 24, 2013, 2 pages.

International Bureau, "PCT International Preliminary Reporton Patentability", dated Nov. 25, 2014, 6 pages, Geneva, Switzerland.

Patent Cooporation Treaty, "Written Opinion of the International Searching Authority", Undated, 12 pages, Munich, Germany.

Federal Service for Intellectual Property (Rospatent), Federal Institute of Industrial Property (FIPS), "Patent Search Report", dated Apr. 3, 2020, 4 pages, Russia.

Patent Office of the Russian Federation, Federal Institute of Industrial Property, "Office Action (Enquiry)", dated Jun. 3, 2020, 9 pages, Russia.

* cited by examiner

VARIABLE INTENSITY AND SELECTIVE PRESSURE ACTIVATED JAR

SUMMARY

The present invention is directed to a kit comprising a funnel element and at least one deformable ball. The funnel element has opposed first and second surfaces joined by a fluid passage having an enlarged and recessed bowl that opens at the first surface and connects with a narrow neck that opens at the opposite second surface. Each of the deformable balls is sized, in its undeformed state, to be seated within the bowl.

The present invention is also directed to a jarring system. The system comprises an elongate tubular string that extends underground and the kit described above. The funnel element of the above described kit is supported at an underground position by the elongate tubular string, and the at least one ball includes one undeformed ball seated within the bowl of the funnel element.

The present invention is further directed to a method for jarring loose a stuck drill string. The method comprises the steps of incorporating a funnel element having a fluid passage into a drill string, blocking a first end of the fluid passage with a deformable ball, and increasing fluid pressure on the ball within the drill string. The method is further directed to the steps of deforming the ball and expelling it out of a second end of the fluid passage, releasing pressurized fluid rapidly through the fluid passage, and jarring the drill string.

DETAILED DESCRIPTION

Figure 1:
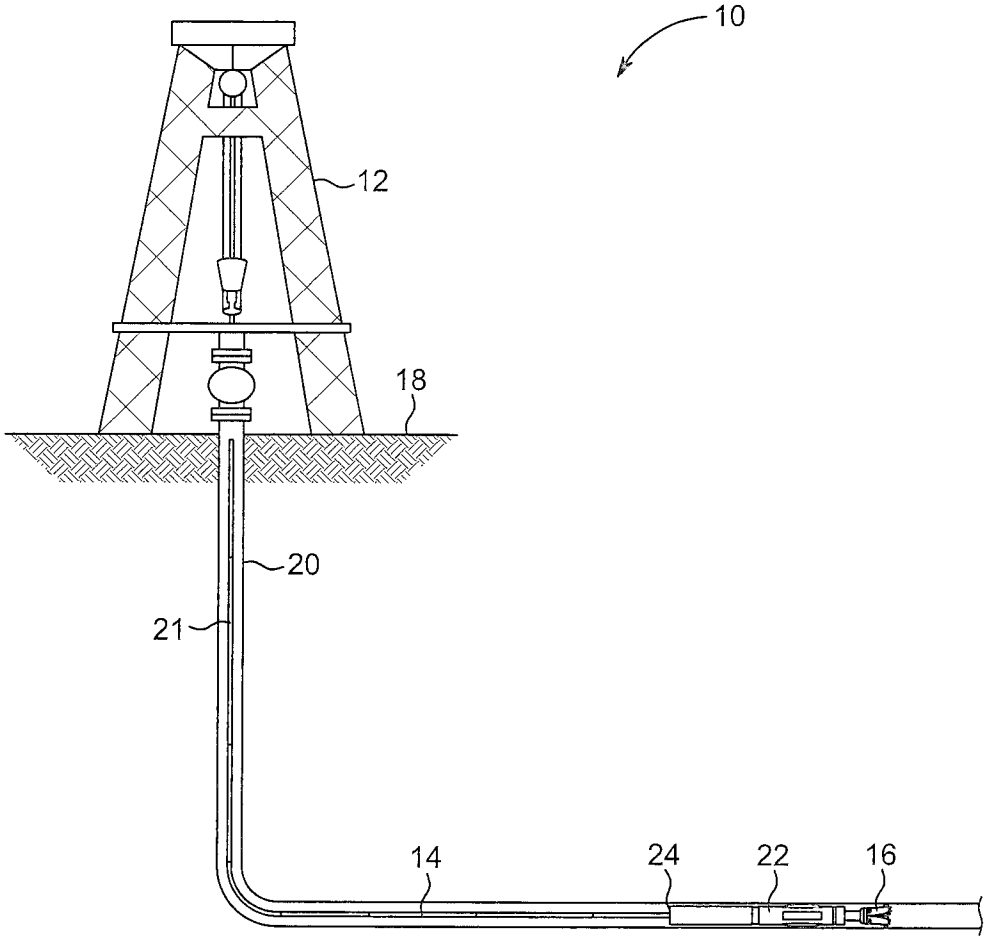
FIG. 1 is a schematic view of a drilling system formed from a series of interconnected rigid pipe sections.

In oil and gas drilling operations, there may arise a need to dislodge a stuck drill string within a wellbore by imparting a jarring impact force on the drill string or the bottom hole assembly. FIG. 1 shows a schematic view of a drilling system 10 used in oil and gas drilling operations. The drilling system 10 comprises surface equipment 12, an elongate tubular string or drill string 14, and a drill bit 16. The surface equipment 12 sits on a ground surface 18. The drill string 14 and the drill bit 16 are shown underground in a wellbore 20. The drill string 14 is made up of a plurality of rigid pipe sections 21 attached end to end. The pipe sections 21 may comprise jointed pipe or drill pipe. A drill pipe drill string 14 is typically used when drilling the initial wellbore 20 or when drilling deep wells because it can typically withstand great amounts of pressure. A jointed pipe drill string 14 may be used when drilling shallow wells or when performing well completion operations. A jointed pipe drill string 14 may not be capable of withstanding as much pressure as a drill pipe drill string 14.

The drilling system 10 works to advance the drill string 14 and the drill bit 16 down the wellbore 20 during drilling operations by rotating the drill string 14 and the drill bit 16. A bottom hole assembly 22 is connected to a terminal end 24 of the drill string 14 prior to the drill bit 16. The bottom hole assembly 22 may comprise one or more tools used in drilling operations, such as mud motors, telemetry equipment, hammers, etc.

Figure 2:
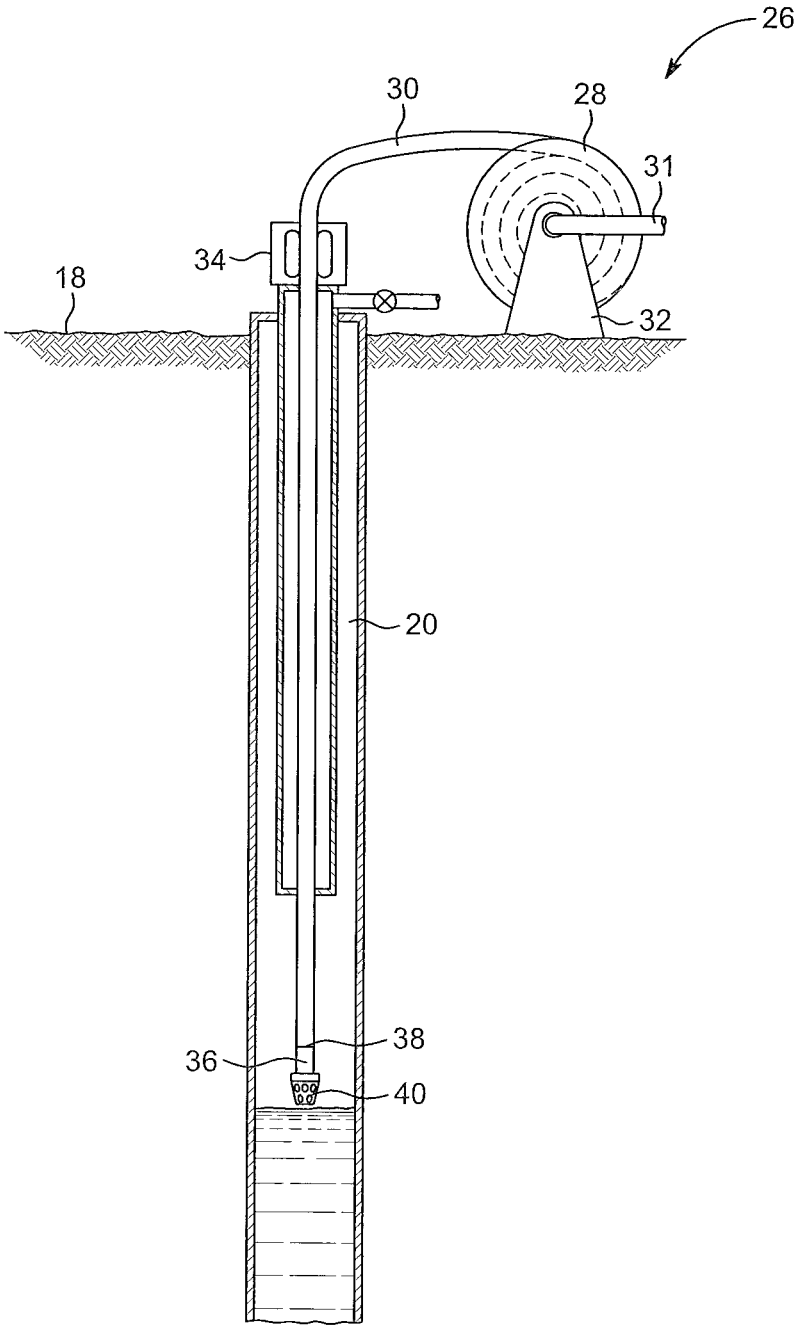
FIG. 2 is a schematic view of a drilling system formed from coiled tubing.

FIG. 2 shows a schematic view of a coiled tubing drilling system 26 used in oil and gas drilling operations. The coiled tubing system 26 comprises surface equipment positioned at the ground surface 18. The surface equipment comprises a spool 28 of an elongate tubular string or coiled tubing 30 attached to a reel 32. The coiled tubing 30 is generally a very long metal pipe that may be between 1-4 inches in diameter. The coiled tubing 30 is advanced along the wellbore 20 using an injector head 34. A bottom hole assembly 36 may be attached to a terminal end 38 of the coiled tubing 30. A drill bit 40 is attached to the bottom hole assembly 36 within the wellbore 20, in FIG. 2.

The coiled tubing system 26 may be used to drill shallow wells or to perform well completion operations. Unlike the drill pipe or jointed pipe drill string 14, the coiled tubing drill string 30 does not rotate and is made up of a continuous string of pipe. This allows fluid to be continuously supplied to the wellbore 20 during operation.

A device capable of producing a jarring impact force on a stuck drill string 14 or coiled tubing drill string 30 is typically referred to as a "jar". Jars known in the art operate mechanically or hydraulically. These jars contain moving parts and must be set or cocked to operate. In some cases, backward movement of the drill string 14 is required to set the jar. In coiled tubing 26 operations, the movement required to set the jar causes the coiled tubing 30 to move back and forth over the injector head 34 at the ground surface 18. This may cause the coiled tubing 30 to break down. In other cases, the jar may be set prior to drilling operations. In such instance, an operator runs the risk of the jar releasing and firing unintentionally.

The present invention is directed to a variable intensity and selective pressure activated jar that may be used with a drill pipe, jointed pipe, or coiled tubing drill string 14, 30. The jar of the present invention is described herein with reference to three embodiments, 100, 200, and 300. The jar 100, shown with reference to FIGS. 3-13, may be used with a drill pipe drill string 14. The jar 100 may be thread directly into a drill pipe drill string 14 prior to drilling the wellbore 20.

The jar 200, shown with reference to FIGS. 14-23, may be incorporated into a jointed pipe drill string 14. The jar 200 may be incorporated into the jointed pipe drill string 14 after the drill string is already within the wellbore 20.

The jars 100 and 200 may be threaded or incorporated into any portion of the drill string 14 desired. However, preferably the jars 100 and 200 are threaded or incorporated into the bottom hole assembly 22 uphole from the motor and telemetry equipment. The jars 100 and 200 are most effective the closer they are to the drill bit 16.

Figure 24:
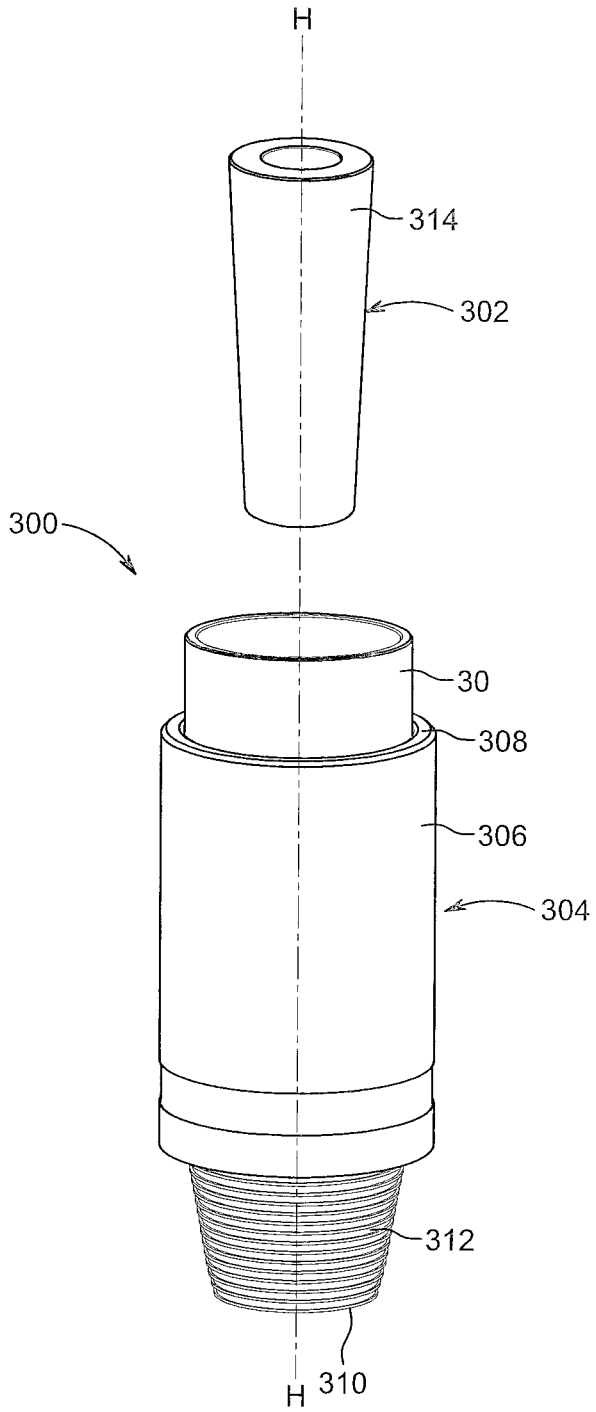
FIG. 24 is an exploded view of a third embodiment of the jar.
Figure 25:
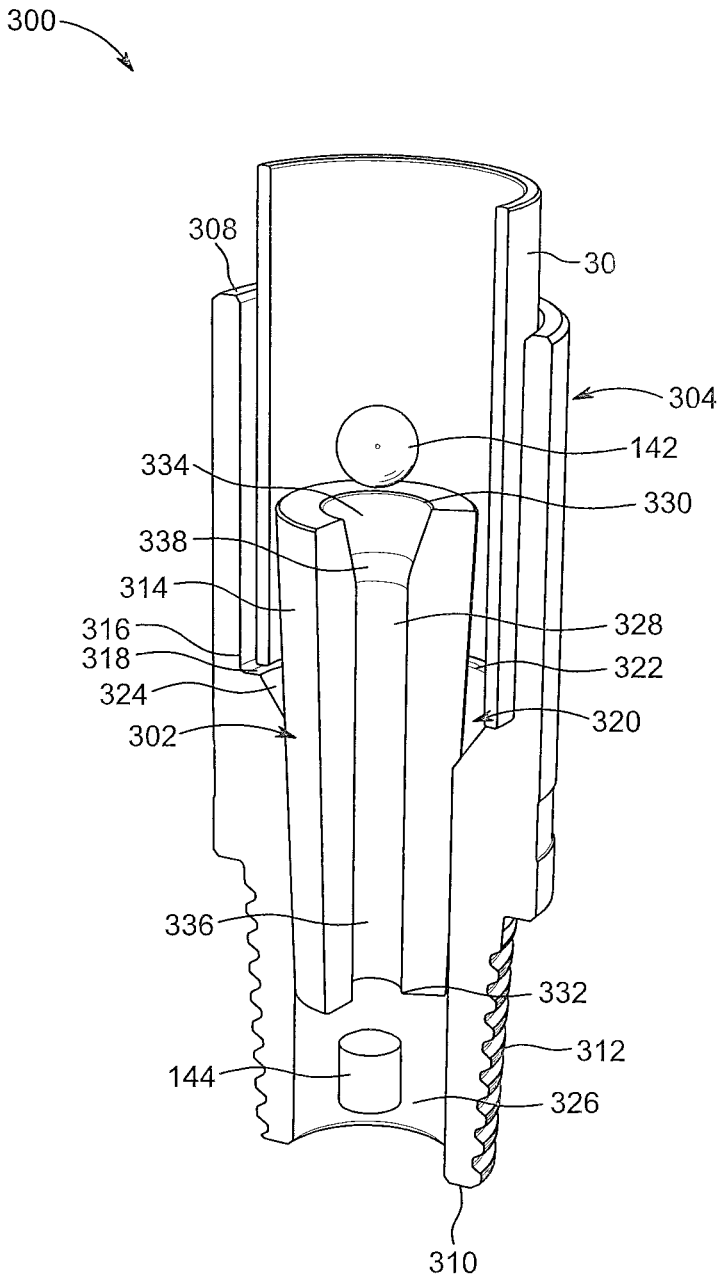
FIG. 25 is a perspective view of the jar shown in FIG. 24 in an assembled configuration. Portions of the funnel element and collar element have been cut away, for better display.
Figure 26:
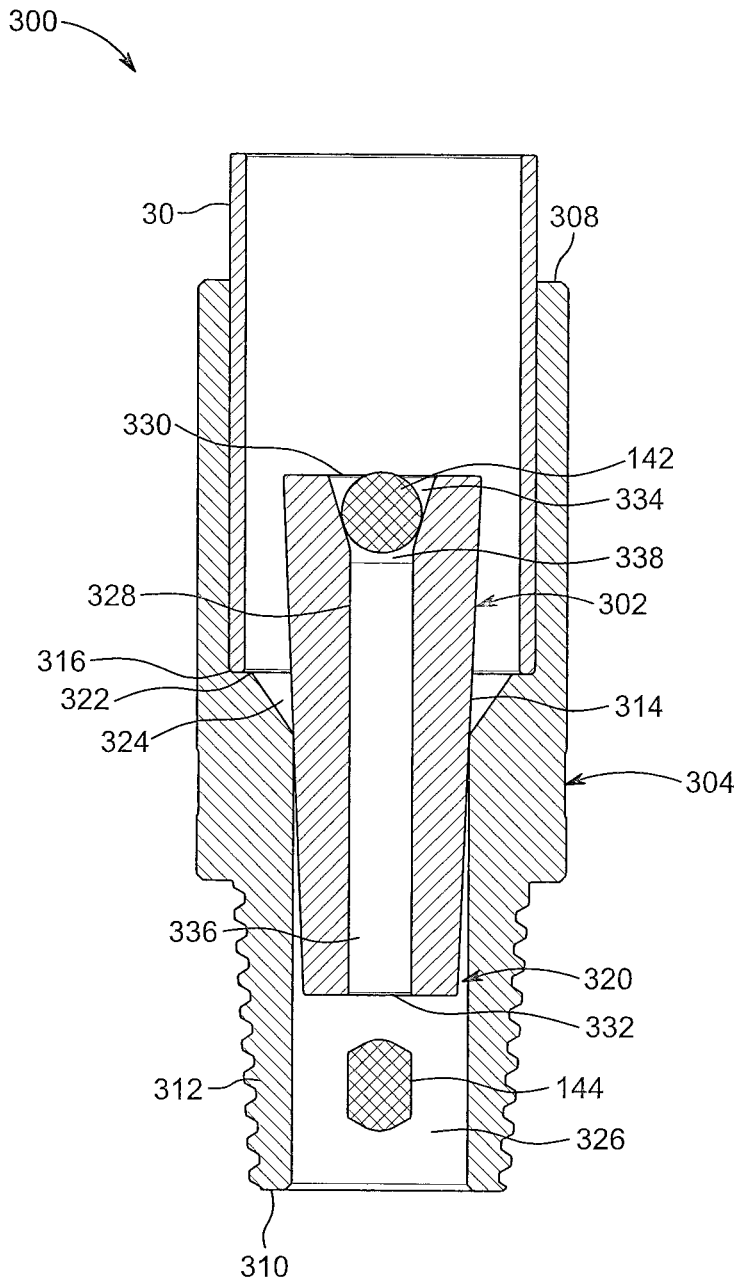
FIG. 26 is a cross-sectional view of the jar shown in FIG. 24 in an assembled configuration. The cross-section is taken along line H-H shown in FIG. 24.

The jar 300, shown with reference to FIGS. 24-26, may be used with the coiled tubing system 26. The jar 300 may be attached to the terminal end 38 of the coiled tubing drill string 30 directly above the bottom hole assembly 36. As described herein, the jars 100, 200, and 300 use the same method to dislodge the drill string 14, 30 or bottom hole assembly 22, 36 from its stuck point within the wellbore 20.

Figure 3:
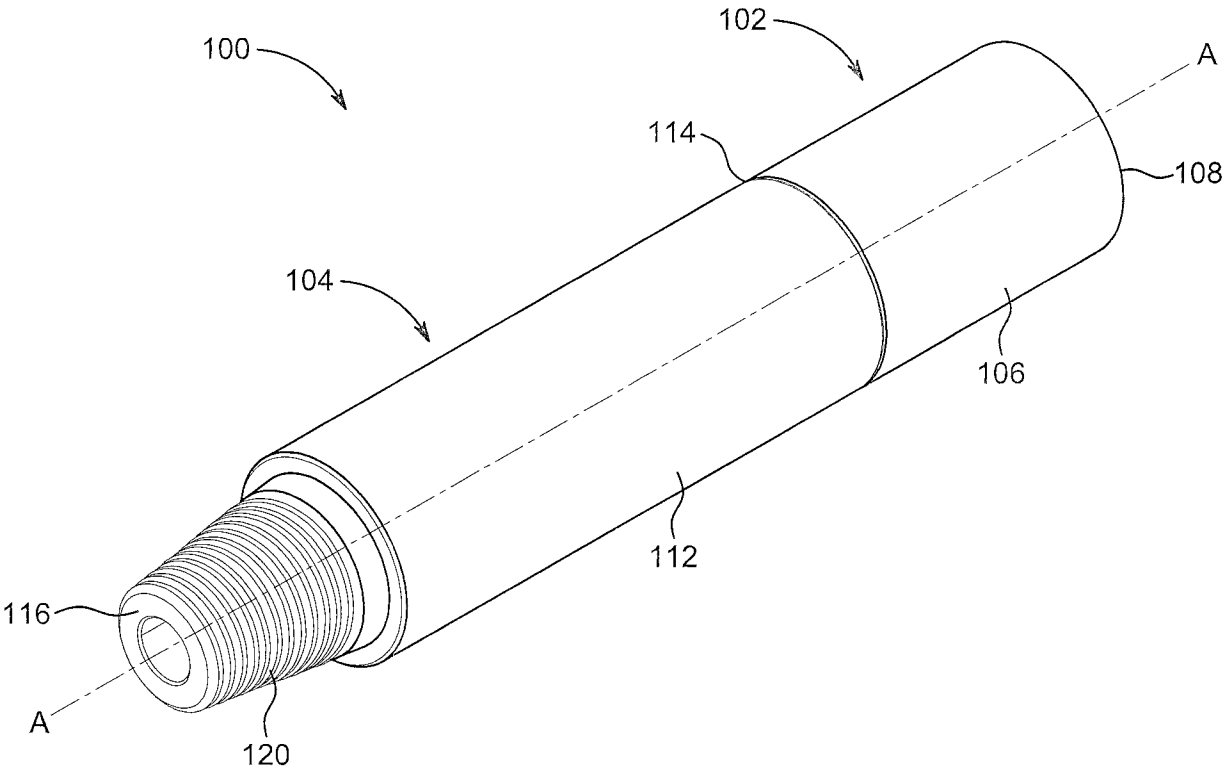
FIG. 3 is perspective view of a jar of the present invention.
Figure 4:
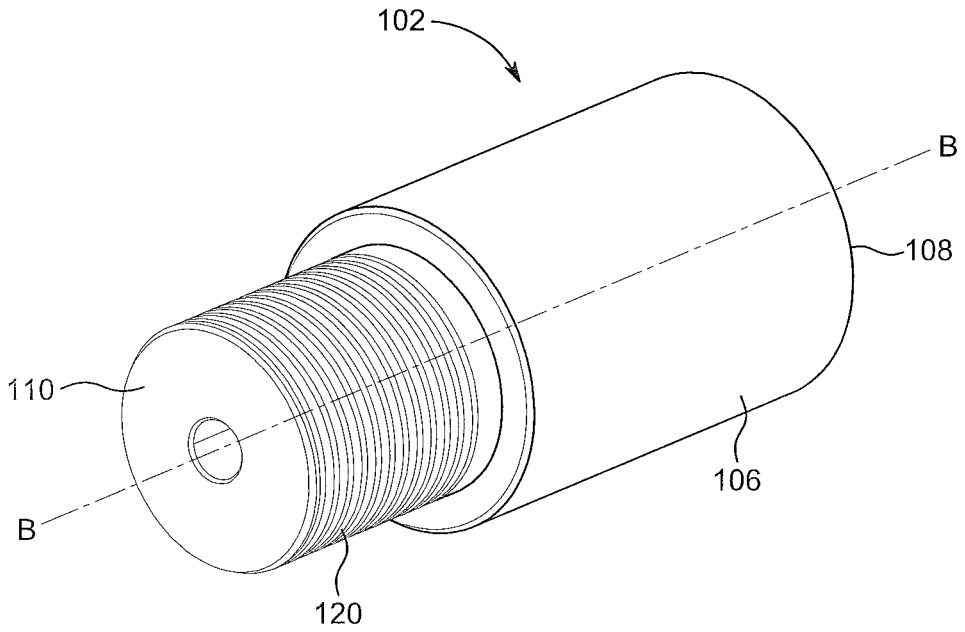
FIG. 4 is a perspective view of a funnel sub of the jar of FIG. 3.

Turning now to FIGS. 3-13, the jar 100 for use with a drill pipe drill string 14 is shown in more detail. The jar 100 comprises a funnel sub 102 and a receiver sub 104. The funnel sub 102 has a cylindrical outer body 106 having a first end 108 and an opposite second end 110 (FIG. 4). The funnel sub 102 opens at the first end 108 and at the second end 110. The receiver sub 104 has an elongate cylindrical outer body 112 having a first end 114 and an opposite second end 116. The receiver sub 104 opens at the first end 114 and at the second end 116.

Figure 5:
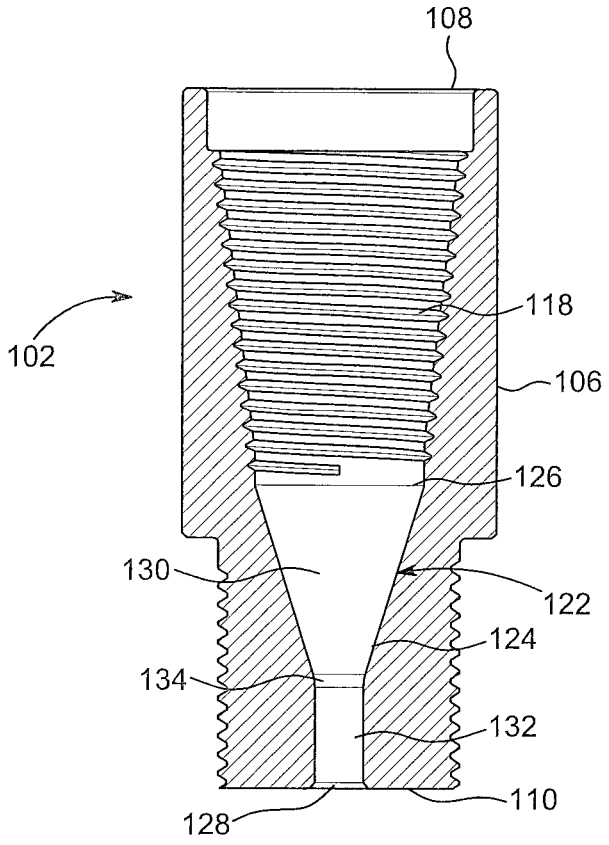
FIG. 5 is a cross-section of the funnel sub shown in FIG. 4, taken along a plane that contains line B-B.
Figure 6:
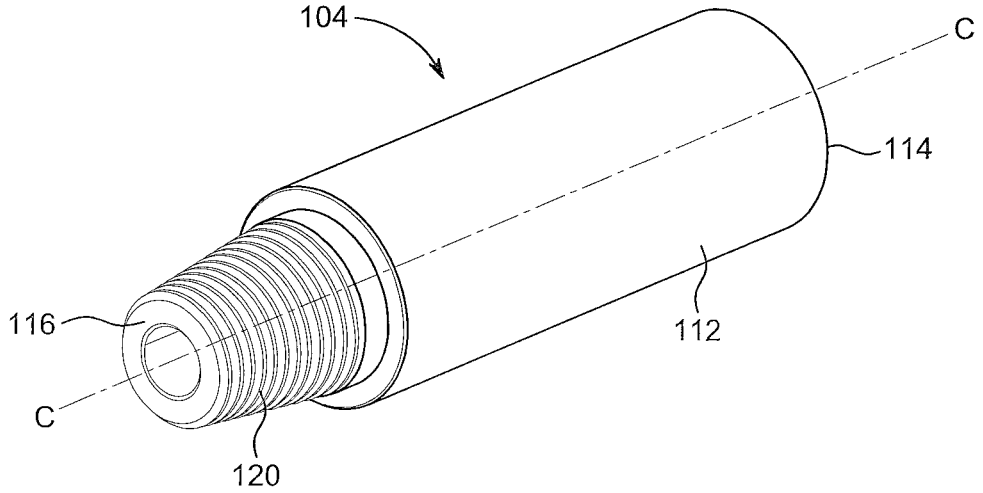
FIG. 6 is a perspective view of a receiver sub of the jar of FIG. 3.
Figure 7:
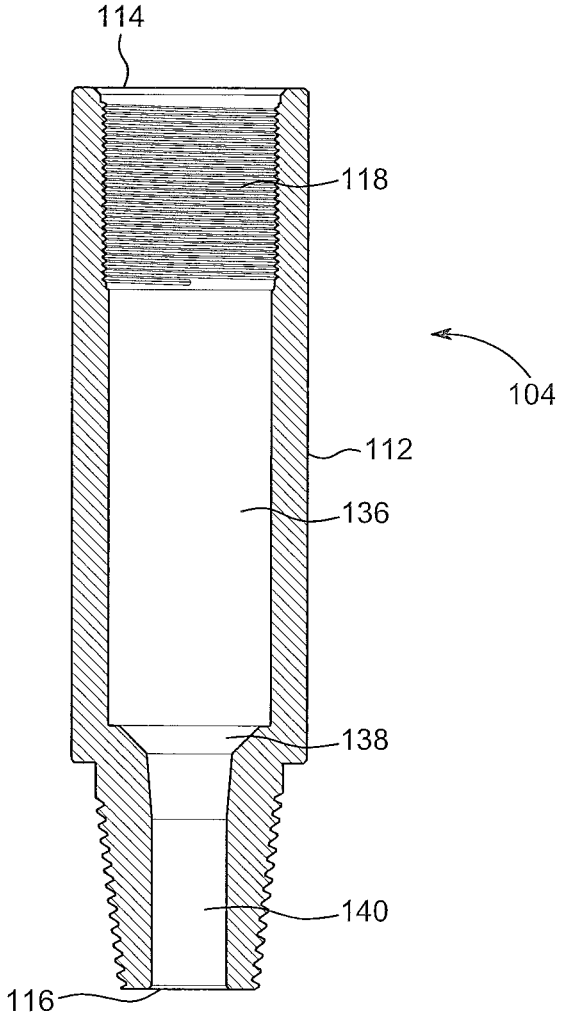
FIG. 7 is a cross-section of the receiver sub shown in FIG. 6, taken along a plane that contains line C-C.

Both the first end 108 of the funnel sub 102 and the first end 114 of the receiver sub 104 have internal threads 118 formed therein (FIGS. 5 and 7). Likewise, both the second end 110 of the funnel sub 102 and the second end 116 of the receiver sub 104 have external threads 120 formed thereon (FIGS. 4 and 6). The second end 110 of the funnel sub 102 threads into the first end 114 of the receiver sub 104 (FIG. 3). Together, the funnel sub 102 and the receiver sub 104 may thread into the drill pipe drill string 14.

The jar 100 is in fluid communication with the drill string 14 when the jar 100 is threaded directly into the drill pipe drill string 14. The outer body 106 and 112 of the jar 100 will contact the sides of the wellbore 20, like the rest of the drill string 14, once the drill string is lowered into the wellbore 20. The jar 100 will also rotate with the drill string 14 during drilling operations.

Turning now to FIG. 5, a cross-section of the funnel sub 102 is shown. The cross-section is taken along a plane that contains line B-B show in FIG. 4. A funnel element 122 is formed inside of the funnel sub 102 below the internal threads 118. The funnel element 122 has a fluid passage 124 that opens at a first surface 126 and an opposite second surface 128. The first surface 126 opens into an enlarged and recessed bowl 130. The bowl 130 tapers inwardly and connects with a narrow neck 132 that opens at the second surface 128 of the funnel element 122. The second surface 128 of the funnel element 122 opens at the second end 110 of the funnel sub 102. The bowl 130 has the shape of a frustum of a right circular cone having a slant angle of between 15 and about 20 degrees. Preferably this angle is 17.5 degrees. The connection between the bowl 130 and the narrow neck 132 forms a seat 134.

Figure 8:
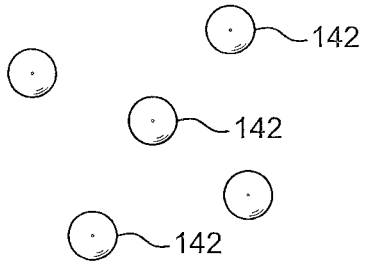
FIG. 8 shows a plurality of deformable balls for use with the jar. The balls are shown in an undeformed state.
Figure 9:
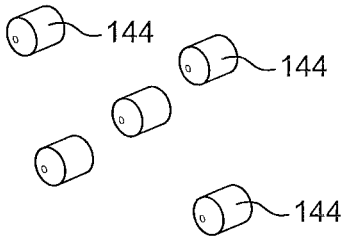
FIG. 9 shows a plurality of deformed balls created by use of the jar.

Fluid from the drill pipe drill string 14 may enter the first end 108 of the funnel sub 102, pass through the funnel element 122 and into the receiver sub 104. A cross-section of the receiver sub 104 is shown in FIG. 7. The cross-section is taken along a plane that contains line C-C shown in FIG. 6. The receiver sub 104 has a receiver chamber 136 that opens at a bottom surface 138 into a fluid passage 140. The fluid passage 140 continues into the drill string 14. The jar 100 itself contains no moving parts. When the jar 100 is not in use, it simply serves as a conduit for fluid to pass through in the drill string 14 or bottom hole assembly 22. The jar 100 is activated by a deformable ball 142. The ball 142 and a deformed ball 144 are shown in FIGS. 8-9.

Figure 10:
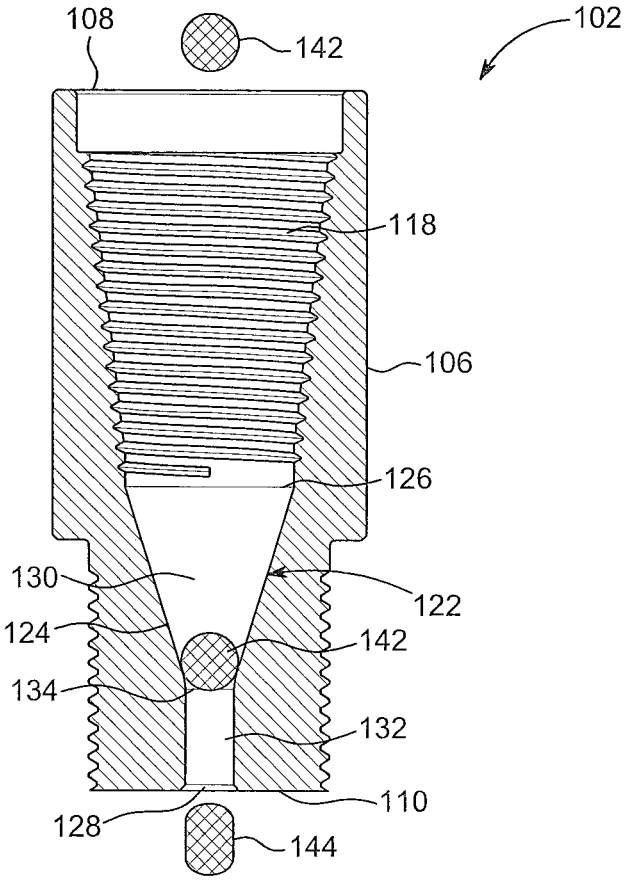
FIG. 10 shows how the deformable ball is positioned relative to the funnel sub of FIG. 5 at successive stages of the jarring process.

Referring now to FIG. 10, the ball 142 is lowered or pumped down the drill string 14 to activate the jar 100. The diameter of the ball 142 is greater than the diameter of the seat 134 formed in the funnel element 122. Thus, the ball 142 will stop movement through the drill string 14 when it reaches the seat 134 formed in the funnel element 122. When the ball 142 is in a seated position within the funnel element 122, the ball 142 will block fluid from flowing between the funnel sub 102 and the receiver sub 104.

If fluid is continually pumped down the drill string 14, hydraulic pressure will build behind the ball 142 and within the portion of the drill string 14 uphole from the funnel sub 102. As hydraulic pressure builds within the drill string 14, the drill string will start to elongate. Eventually, the hydraulic pressure pushing on the ball 142 will exceed the amount of pressure the ball 142 can withstand. This will cause the ball 142 to deform and be expelled through the narrow neck 132 of the funnel element 122.

The deformed ball 144 may be expelled through the funnel element 122 at a rate of 22,000-23,000 feet/second.

As the deformed ball 144 is expelled through the funnel element 122, fluid behind the ball will rapidly release through the narrow neck 132 of the funnel element 122. Fluid will rapidly release due to the significant amount of hydraulic pressure built up in the drill string 14. The rapid release of fluid will cause a dynamic event within the wellbore 20. The dynamic event is characterized by a sheer wave throughout the drill string 14 that causes a powerful jarring or jolting of the drill string 14 within the wellbore 20. The sheer wave is the result of the drill string 14 returning back to its natural state after being elongated by hydraulic pressure. The jarring or jolting of the drill string 14 works to dislodge the drill string 14 from its stuck point within the wellbore 20.

The jar 100 is capable of bi-directional jarring. This means that the dynamic event may jar the drill string 14 uphole from the jar 100 and the drill string or bottom hole assembly 22 downhole from the jar 100. The ease of dislodging the drill string 14 or bottom hole assembly 22 from its stuck point may be increased by using the surface equipment 12 to push or pull on the drill string 14 at the same time the jarring or jolting of the drill string takes place.

If the first dynamic event does not dislodge the drill string 14 or bottom hole assembly 22 from its stuck point, a second ball 142 may be pumped down the drill string 14 until it lands on the seat 134. Hydraulic pressure may again build behind the ball 142 until the pressure exceeds that which the ball can withstand and deforms the ball 142. The deformed ball 144 is expelled through the funnel element 122 causing the rapid release of fluid and a second dynamic event within the wellbore 20. This process may be repeated as many times as needed until the drill string 14 is dislodged from its stuck point within the wellbore 20. The use of the balls 142 to activate the jar 100 negates the need to set or cock the jar prior to firing. Thus, the jar 100 cannot be unintentionally fired downhole.

The balls 142 used to activate the jar 100 may have varying diameters. The greater the diameter of the ball 142, the greater the hydraulic pressure needed to deform the ball. The greater the hydraulic pressure built within the drill string 14, the more powerful the dynamic event. Thus, the greater the diameter of the ball 142, the more powerful the dynamic event or jarring of the drill string 14 and bottom hole assembly 22 that will take place within the wellbore 20.

The balls 142 are preferably solid and made of nylon, but can be made out of any material that is capable of deforming under hydraulic pressure and withstanding high temperatures within the wellbore 20. The balls 142 may also be porous and coated in a nano-particulate matter, the contents of which are a trade secret. The matter helps add friction between the ball 142 and the funnel element 122. The greater the friction between the ball 142 and the funnel element 122, the more hydraulic pressure will be required to extrude the ball through the funnel element. Due to this, the nano-particulate matter helps control the rate at which the deformed balls 144 are extruded through the funnel element 122.

In operation, an operator in charge of activating the jar 100 is typically provided with a set of balls 142 varying in diameter. The operator may start by first sending a control ball 142 down the drill string 14 to activate the jar 100. The control ball 142 is used to gain information about the conditions within the wellbore 20. This is important because each wellbore 20 may vary in depth, and the depth of the jar 100 within the wellbore 20 at the time the drill string 14 becomes stuck may vary. Due to this, the same size balls 142 may extrude at different pressures within each wellbore 20.

The operator may use any size ball 142 as a control ball. For example, the operator may choose the ball 142 with the smallest diameter as the control ball. This may be because the ball 142 with the smallest diameter will create the least powerful dynamic event, because it deforms under the least amount of hydraulic pressure. Once the control ball 142 has been extruded through the funnel element 122 and the jarring event takes place, the operator may try to move the drill string 14 within the wellbore 20. The operator can then determine what size ball 142 to use next based on the amount of movement of the drill string 14. For example, the control ball 142 alone may dislodge the drill string 14 or bottom hole assembly 22 from its stuck point. Alternatively, the drill string 14 may not move at all after using the control ball 142. In such case, it might be useful to jump up several sizes and use a ball 142 that creates a more powerful dynamic event within the wellbore 20. A larger sized ball 142 may be used as the control ball 142 if the operator knows beforehand that the drill string 14 will require a larger jarring event to attempt to dislodge it from its stuck point.

The operator may determine the amount of pressure required within the wellbore 20 to extrude each of the different sized balls 142 by watching the pressure gage at the ground surface 18. The pressure will build while the ball 142 is seated within the funnel element 122 and the pressure will drop once the deformed ball 144 is extruded. Once the operator determines the pressure required to deform and extrude the control ball 142 through the funnel element 122, the operator can determine the approximate amount of pressure required to deform and extrude the other sized balls.

Figure 11:
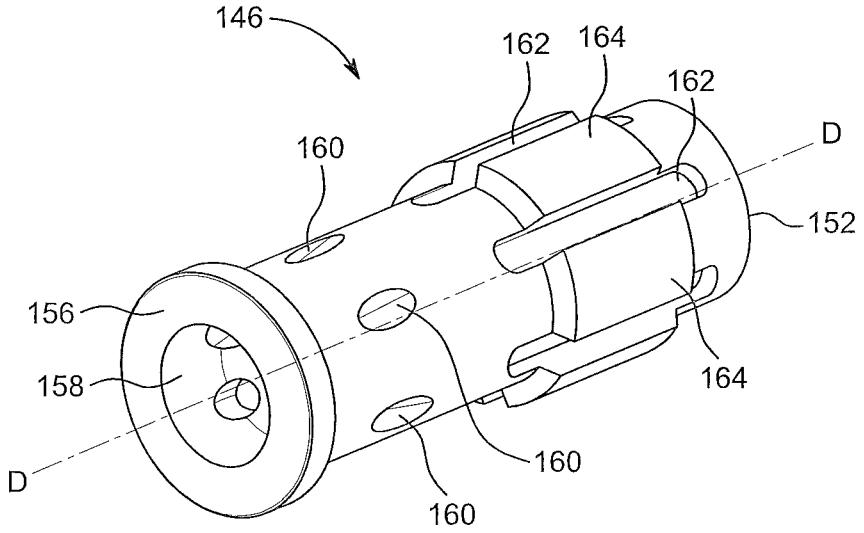
FIG. 11 is a perspective view of an elongate cartridge for use with the jar of FIG. 3.
Figure 12:
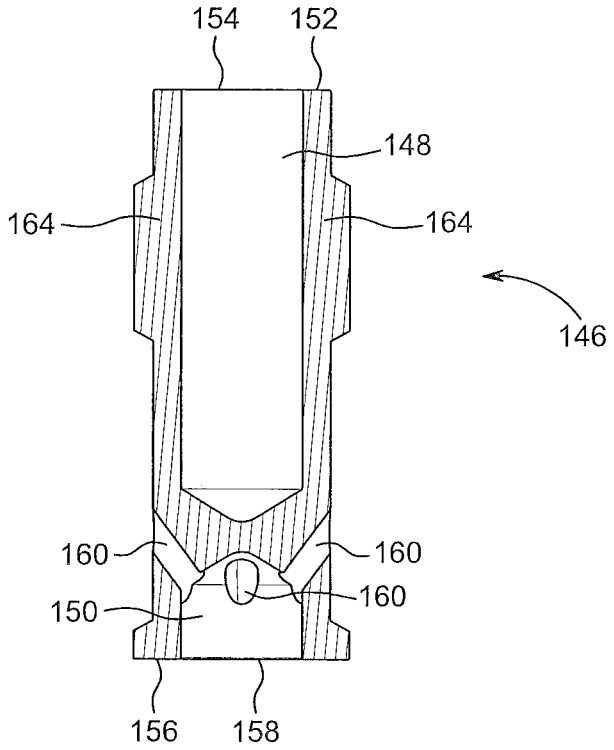
FIG. 12 is a cross-section of the cartridge shown in FIG. 11, taken along a plane that contains line D-D.

Turning now to FIGS. 11-12, an elongate cartridge 146 is shown. A cross-section of the elongate cartridge 146 is shown in FIG. 12. The cross-section is taken along a plane that includes line D-D shown in FIG. 11. The elongate cartridge 146 is used to catch the deformed balls 144 after they are expelled through the funnel element 102. The elongate cartridge 146 may be installed in the receiver chamber 136 of the receiver sub 104. The elongate cartridge 146 comprises a first cartridge chamber 148 and a second cartridge chamber 150 that are longitudinally offset from one another. The first cartridge chamber 148 opens at a first end 152 of the elongate cartridge 146 via a port 154. The second cartridge chamber 150 opens at a second end 156 of the elongate cartridge 146 via a fluid opening 158. The second cartridge chamber 150 has at least two ports 160 that open on the sides of the elongate cartridge 146. The ports 160 are in fluid communication with the receiver chamber 136.

Figure 13:
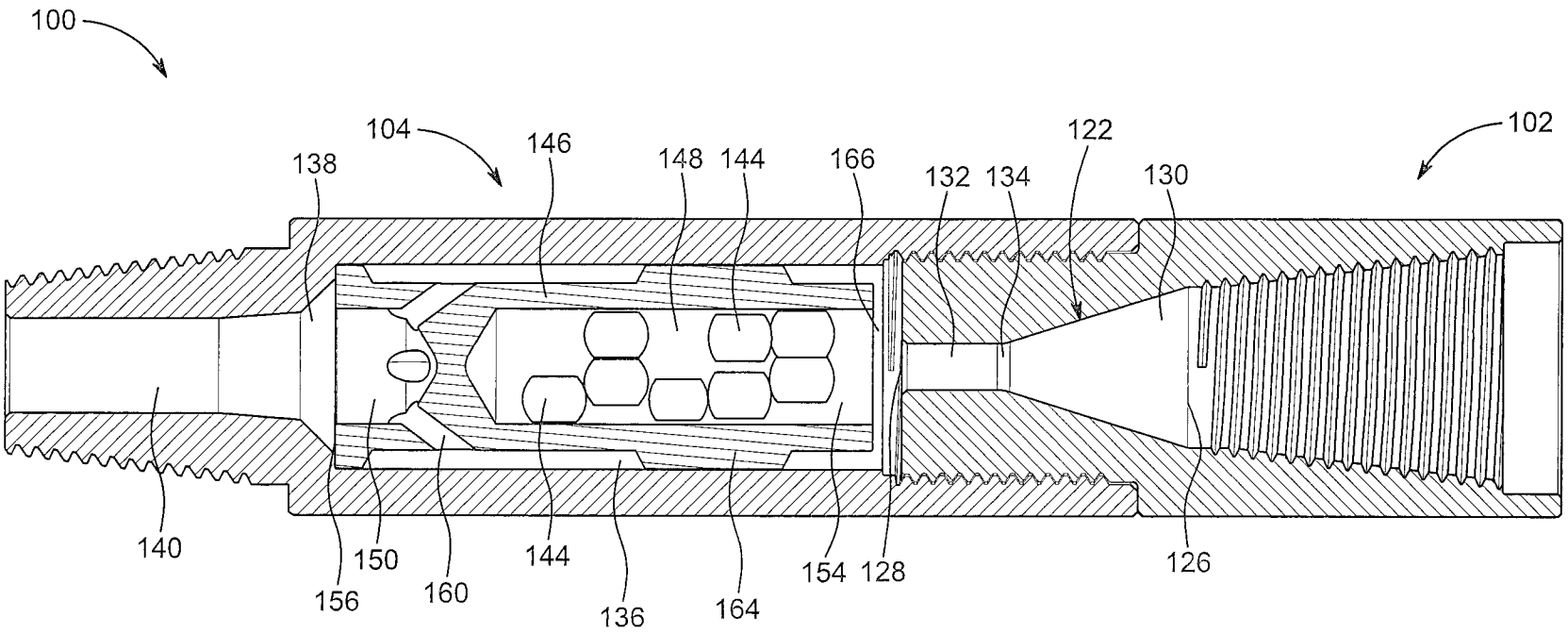
FIG. 13 is a cross section of the jar shown in FIG. 3, taken along a plane that contains line A-A. The cartridge shown in FIG. 11 has been installed within the receiver sub. Deformed balls are shown within the cartridge.

With reference to FIG. 13, a cross-section of the jar 100 is shown. The cross-section is taken along a plane that includes line A-A shown in FIG. 3. The elongate cartridge 146 is installed in the receiver chamber 136 of the receiver sub 104 such that the second end 156 of the elongate cartridge 146 engages with the bottom surface 138 of the receiver chamber 136. The port 154 of the first cartridge chamber 148 is situated directly below the second surface 128 of the funnel element 122. Deformed balls 144 that are expelled out of the funnel element 122, pass through the port 154, and are contained within the first cartridge chamber 148.

A series of fluid lanes 162 (FIG. 11) are also formed on the outer surface of the elongate cartridge 146 proximate its first end 152. The fluid lanes 162 help direct fluid within the receiver chamber 136 of the receiver sub 104 into the ports 160 that lead into the second cartridge chamber 150. An elongate shoulder 164, shown in FIGS. 11 and 13, is formed in between each fluid lane 162. The elongate shoulders 164 engage with the wall of the receiver chamber 136 to help direct fluid into each fluid lane 162.

Continuing with FIG. 13, the elongate cartridge 146 is installed in the receiver chamber 136 such that a small space 166 exists between the second surface 128 of the funnel element 122 and the port 154 of the first cartridge chamber 148. The space 166 is large enough to allow fluid to flow into the receiver chamber 136, but small enough to keep the deformed balls 144 from flowing into the receiver chamber. The deformed balls 144 can only pass from the funnel element 122 into the first cartridge chamber 148. The space 166 and the fluid lanes 162 create zones of clearance for fluid to pass from the receiver chamber 136 into the second cartridge chamber 150.

Fluid may flow from the funnel element 122 through the space 166 and into the receiver chamber 136. The elongate shoulders 164 of the elongate cartridge 146 direct fluid into the fluid lanes 162. The fluid lanes 162 direct fluid from the receiver chamber 136 into the ports 160 formed in the second cartridge chamber 150. Fluid in the second cartridge chamber 150 is directed into the fluid passage 140 in the receiver sub 104. The fluid passage 140 directs fluid into the drill string 14 and bottom hole assembly 22 downhole from the jar 100.

Figure 14:
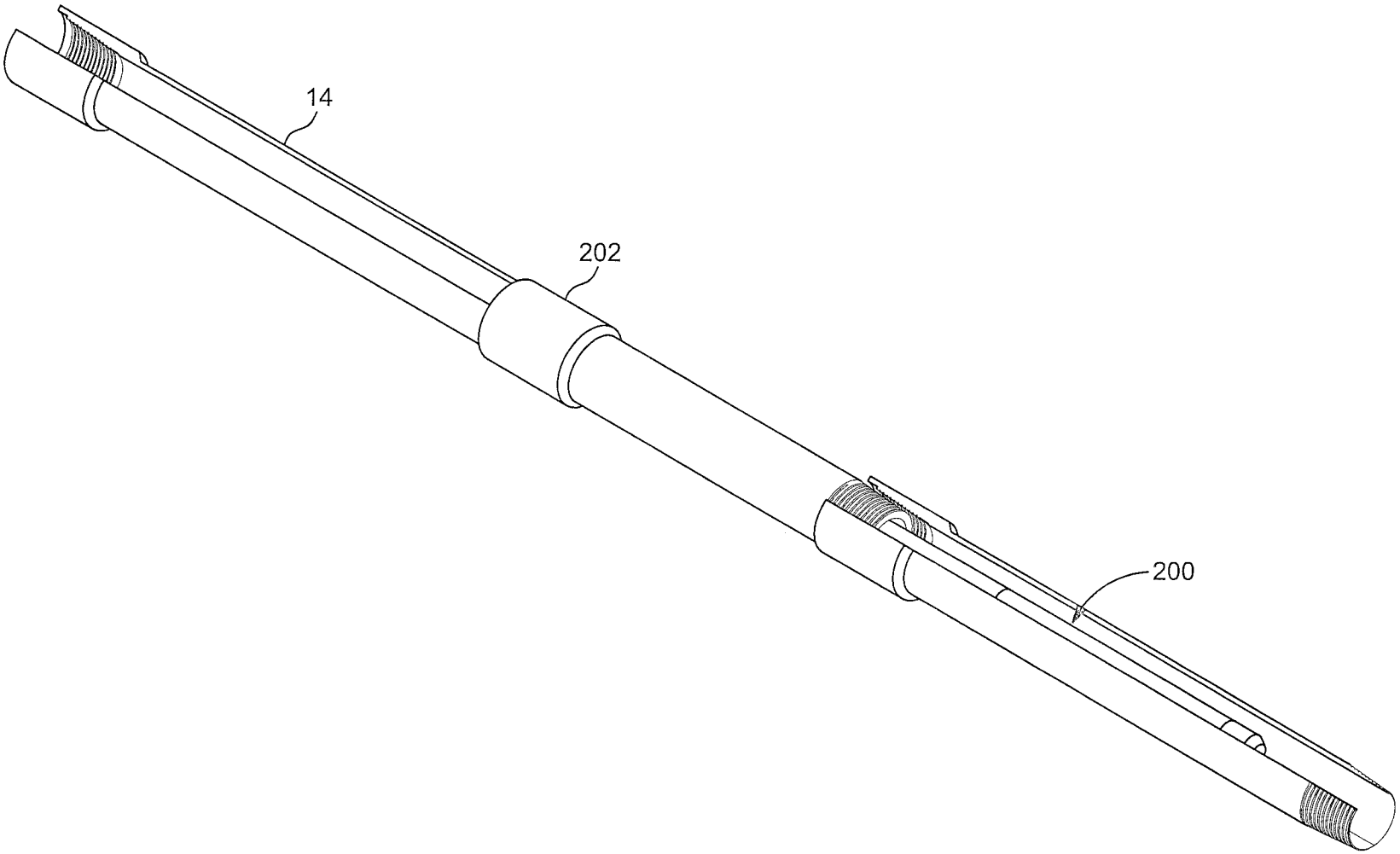
FIG. 14 is a perspective view of a portion of a drill string within which a second embodiment of a jar has been installed. For better display of components, portions of the drill string have been cut away.
Figure 15:
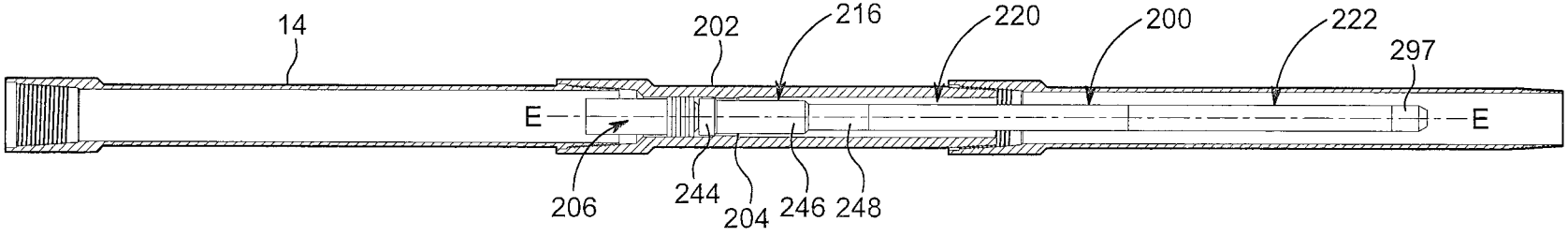
FIG. 15 is a cross-sectional view of the jar of FIG. 14, shown in an installed position within a drill string. A pump-down sub and a cross-over sub at the upper end of the jar engage a landing sub of the drill string.
Figure 16:
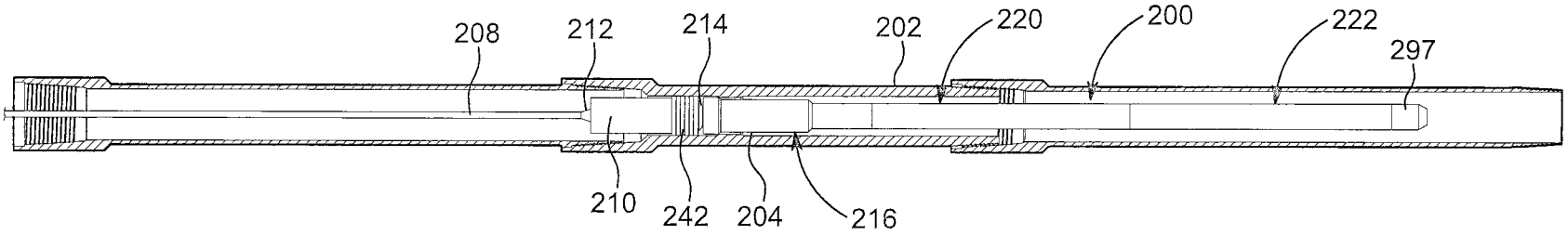
FIG. 16 is another cross-sectional view of the jar of FIG. 14, shown in a different installation configuration within a drill string. The jar is suspended within the drill string from a wireline.

Turning now to FIGS. 14-23, the jar 200 for use with a jointed pipe drill string 14 is shown in more detail. Unlike the jar 100, the jar 200 cannot be threaded directly into the drill string 14. The jar 200 forms a substring that is incorporated into a drill string 14 or bottom hole assembly 22, as shown in FIGS. 14-16. The jar 200 may be incorporated into the drill string 14 or bottom hole assembly 22 by using a landing sub 202 or a locking mandrel (not shown).

The landing sub 202 may be threaded into the drill string 14 or the bottom hole assembly 22 prior to starting drilling operations. The landing sub 202 is configured for receiving the jar 200. The landing sub 202 comprises an annular shoulder 204 (FIGS. 15-16) that stops the jar 200 from moving further down the drill string 14. A pump down sub 206 may be attached to the jar 200. The pump down sub 206 may be used to lower or pump the jar 200 down the drill string 14 until it engages with the landing sub 202.

If a landing sub 202 is not included in the drill string 14 already in the wellbore 20, the jar 200 may be attached to a locking mandrel and then pumped down the drill string 14. The locking mandrel may lock the jar 200 in a desired position within the drill string 14 or bottom hole assembly 22.

The jar 200 may also be sent down the drill string 14 on a wireline 208 (FIG. 16). If the jar 200 is sent down on a wireline 208, a wireline tool 210 is used in place of the pump down sub 206. The wireline tool 210 is attached to the wireline 208 on its first end 212 and the jar 200 on its second end 214. The wireline 208 extends between the tool 210 and the ground surface 18. The wireline 208 is used to lower or send the wireline tool 210 and the jar 200 down the drill string 14 until it engages with the landing sub 202.

Alternatively, a locking mandrel may be attached to the wireline tool 210 and jar 200. In this case, the wireline tool 210 sends the jar 200 and locking mandrel down the drill string 14 until they reach the desired position. Once in the desired position within the drill string 14 or bottom hole assembly 22, the locking mandrel may lock the jar 200 in place. The jar 200 may also be incorporated into the drill string 14 or bottom hole assembly 22 at the ground surface 18 prior to starting drilling operations.

Figure 17:
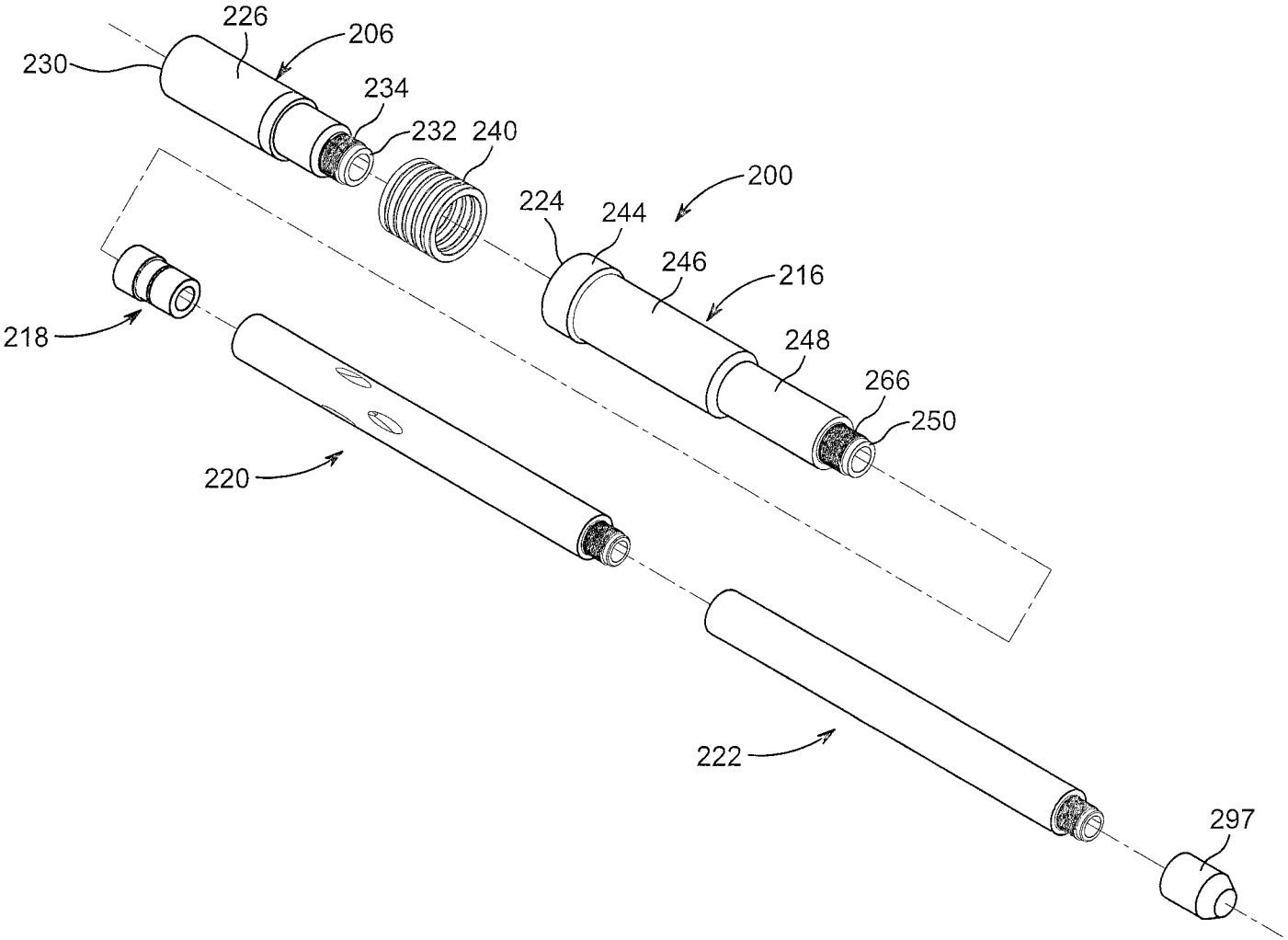
FIG. 17 is an exploded view of the jar shown in FIG. 15.
Figure 18:
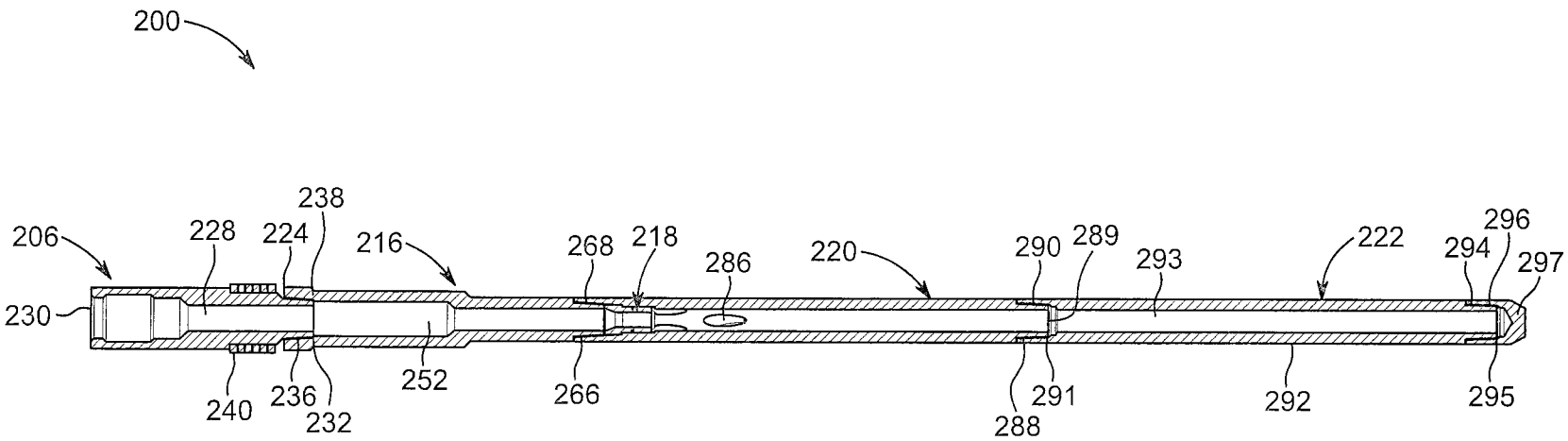
FIG. 18 is a cross-sectional view of the jar shown in FIG. 15, taken along line E-E.
Figure 19:
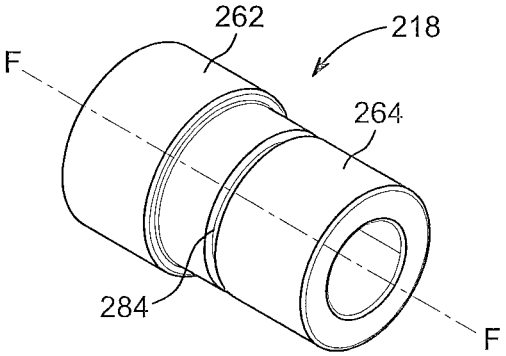
FIG. 19 is an enlarged perspective view of the funnel sub of the jar shown in FIGS. 17 and 18.

Turning to FIG. 17-18, the jar 200 is shown in more detail. FIG. 17 shows an exploded view of the jar 200 that includes the pump down sub 206. FIG. 18 is a cross-sectional view of the jar shown in FIG. 15, taken along line E-E. The pump down sub 206 is also shown attached to the jar 200 in FIG. 18. The jar 200 comprises a cross-over sub 216, a funnel sub 218, a fluid release sub 220, and a receiver sub 222. The subs 216, 218, 220, and 222 are attached end-to-end to one another to form a substring or the jar 200. The subs 216, 218, 220, and 222 are also all in fluid communication with one another when attached together.

The pump down sub 206 is shown attached to a first end 224 of the jar 200. The pump down sub 206 has a cylindrical outer body 226 with a longitudinal internal fluid passage 228 (FIG. 18). The fluid passage 228 opens at a first end 230 and an opposite second end 232 of the pump down sub 206. A set of external threads 234 are formed on the second end 232 of the pump down sub 206. The external threads 234 engage with internal threads 236 formed in a first end 238 of the cross-over sub 216 (FIG. 18).

A set of seals or vee packing 240 is disposed around the body 226 of the pump down sub 206 proximate its second end 232. Once the jar 200 is engaged with the landing sub 202, the vee packing 240 helps seal fluid from entering the space between the jar 200 and the drill string 14. This helps maintain hydraulic pressure within the drill string 14. The wireline tool 210 may also have vee packing 242 (FIG. 16) around its outer body to help maintain hydraulic pressure within the drill string 14. Similarly, if a locking mandrel is used in place of the landing sub 202, the locking mandrel may have vee packing disposed around its outer body to help maintain hydraulic pressure within the wellbore 20.

The cross-over sub 216 is used to engage with the landing tool 202 or a locking mandrel. The outer surface of the cross-over sub 216 has a top flange 244, a middle section 246, and a bottom section 248. The top flange 244 is formed proximate the first end 238 of the cross-over sub 216 and has a greater diameter than the middle section 246. The middle section 246 has a greater diameter than the bottom section 248. The bottom section 248 is formed proximate a second end 250 of the cross-over sub 216. As shown in FIGS. 15-16, the middle section 246 will engage with the annular shoulder 204 in the landing sub 202, and the top flange 244 will prevent the cross-over sub 216 from moving past the annular shoulder 204. The cross-over sub 216 may vary in size and diameter depending on the size of the landing sub 202 used during drilling operations. If a locking mandrel is used in place of the landing sub 202, the cross-over sub 216 may thread onto the end of the locking mandrel.

The cross-over sub 216 has a longitudinal internal fluid passage 252 that opens at its first end 224 and its opposite second end 250. The fluid passage 252 is inline with the fluid passage 228 formed in the pump down sub 206. Fluid from the pump down sub 206 passes into the fluid passage 252 of the cross-over sub 216. Alternatively, the wireline tool 210 may have a fluid passage (not shown) to pass fluid between the tool 210 and the cross-over sub 216. Likewise, fluid may pass from a passage in the locking mandrel into the cross-over sub 216.

Figure 20:
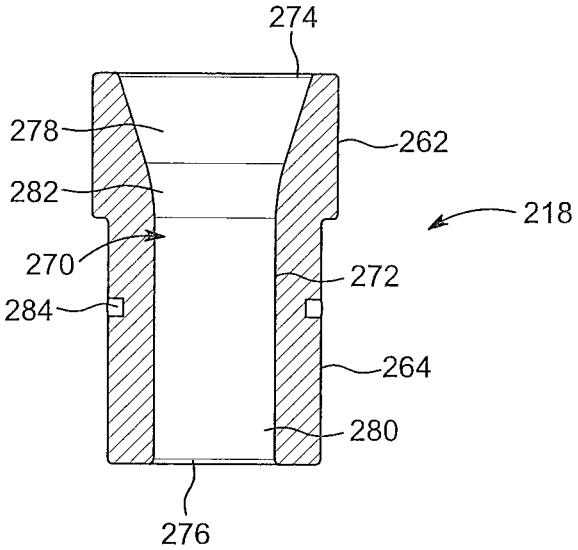
FIG. 20 is a cross-sectional view of the funnel sub shown in FIG. 19, taken along a plane that contains line F-F.
Figure 21:
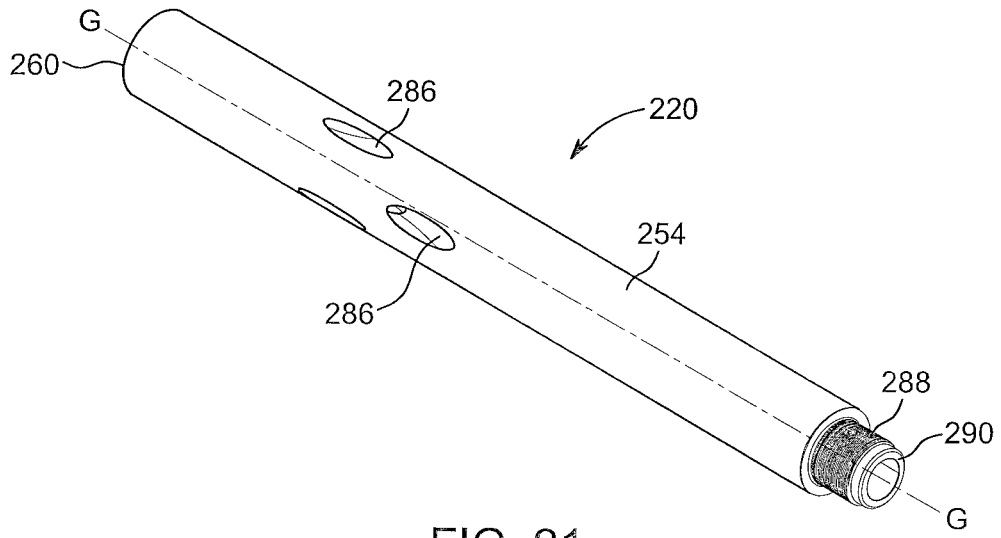
FIG. 21 is an enlarged perspective view of a fluid release sub of the jar shown in FIGS. 17 and 18.
Figure 22:
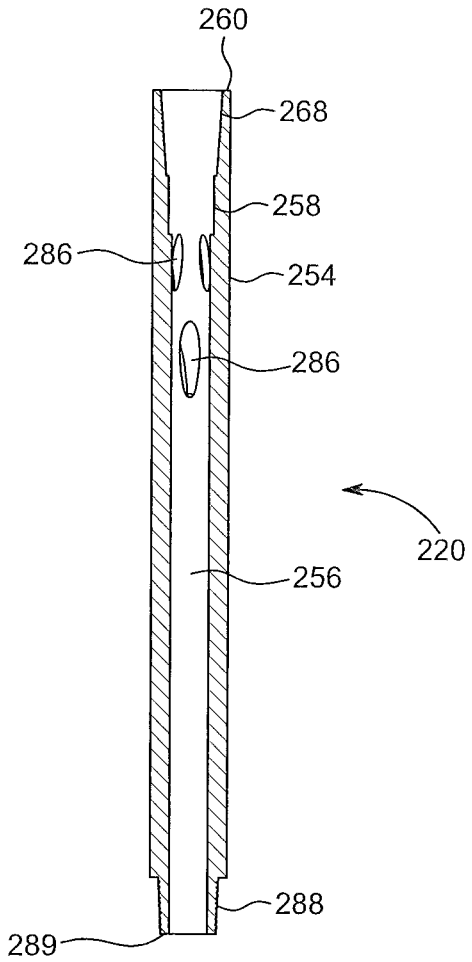
FIG. 22 is a cross-sectional view of the fluid release sub shown in FIG. 21, taken along a plane that contains line G-G.

Turning now to FIGS. 19-22, the funnel sub 218 and fluid release sub 220 are shown in more detail. The fluid release sub 220 has a cylindrical outer body 254 and a longitudinal internal fluid passage 256. The fluid passage 256 is shown in FIG. 22. FIG. 22 is a cross-section of the fluid release sub shown in FIG. 21, taken along a plane that includes line G-G. An annular shoulder 258 is formed in the fluid passage 256 proximate a first end 260 of the fluid release sub 220. The funnel sub 218 sits inside of the fluid passage 256 formed in the fluid release sub 220. The annular shoulder 258 prevents the funnel sub 218 from moving farther down the fluid passage 256.

The outer surface of the funnel sub 218 has a top flange 262 and a bottom section 264. The top flange 262 has a greater diameter than the bottom section 264. When the funnel sub 218 is in the fluid passage 256 of the fluid release sub 220, the bottom section 264 of the funnel sub 218 engages with the annular shoulder 258 and the top flange 262 prevents the funnel sub 218 from moving past the annular shoulder 258. The cross-over sub 216 has a set of external threads 266 that engage with internal threads 268 on the fluid release sub 220 (FIG. 22). The cross-over sub 216 secures the funnel sub 218 in place within the fluid release sub 220 by threading into the internal threads 268 in the fluid release sub 220, as shown in FIG. 18.

Like jar 100, a funnel element 270 is formed inside of the funnel sub 218. The funnel element 270 is shown in FIG. 20. FIG. 20 is a cross-section the funnel sub of FIG. 19, taken along a plane that includes line F-F. The funnel element 270 has a fluid passage 272 that opens at a first surface 274 and an opposite second surface 276. The first surface 274 opens into an enlarged and recessed bowl 278. The bowl 278 tapers inwardly and connects with a narrow neck 280 that opens at the second surface 276 of the funnel element 270. The bowl 278 has the shape of a frustum of a right circular cone having a slant angle of between 15 and about 20 degrees. Preferably this angle is 17.5 degrees. The connection between the bowl 278 and the narrow neck 280 forms a seat 282.

When the funnel sub 218 is in the fluid release sub 220, fluid from the cross-over sub 216 passes through the funnel element 270 and into the fluid release sub 220. An O-ring or a seal 284 may be disposed around the bottom section 264 of the funnel sub 220 to prevent fluid from passing around the outer surface of the funnel sub 218 and into the fluid release sub 220. This helps maintain hydraulic pressure within the drill string 14.

Referring now to FIGS. 21-22, the fluid release sub 220 has a plurality of fluid vents 286 that extend from the fluid passage 256 to its outer body 254. When fluid enters the fluid release sub 220 after passing through the funnel element 270, it may be expelled through the fluid vents 286. Fluid released from the fluid release sub 220 re-enters the drill string 14 (FIGS. 14-16).

The fluid release sub 220 further comprises a set of external threads 288 formed on its second end 289. The external threads 288 engage with internal threads 290 formed in a first end 291 of the receiver sub 222 (FIG. 18). The receiver sub 222 has a cylindrical outer body 292 and a longitudinal internal receiver chamber 293. The receiver sub 222 further comprises a set of external threads 294 formed on its second end 295. The external threads 294 engage with internal threads 296 formed in an end cap 297. The receiver chamber 293 terminates at the end cap 297. The receiver chamber 293 is in fluid communication with the fluid passage 256 of the fluid release sub 220.

Figure 23:
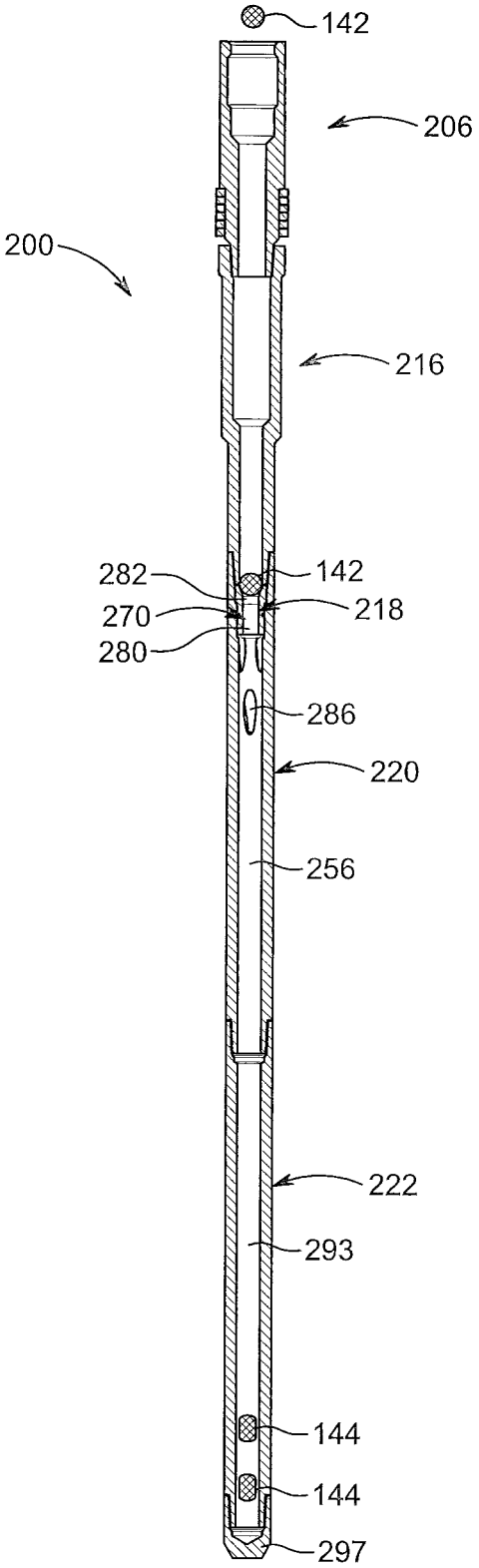
FIG. 23 shows how the deformable ball is positioned relative to the jar of FIG. 18 at successive stages of the jarring process.

Turning now to FIG. 23, activation of the jar 200 is shown in greater detail. Once the jar 200 is set in place within the drill string 14 or bottom hole assembly 22, the jar 200 may be activated. The same balls 142, 144 and operation described with reference to jar 100 may be used with jar 200. Like jar 100, to activate the jar 200, a deformable ball 142 is sent down the drill string 14. The ball 142 is stopped once it reaches the seat 282 formed in the funnel element 270. The ball 142 prevents fluid from passing from the funnel sub 218 into the fluid release sub 220. Hydraulic pressure builds on the ball 142 until it exceeds the pressure the ball can withstand. Once the pressure the ball 142 can withstand is exceeded, the ball will deform and be expelled through the narrow neck 280 of the funnel element 270. The deformed ball 144 will pass through the fluid passage 256 of the fluid release sub 220 and be captured within the receiver chamber 293 of the receiver sub 222.

As the deformed ball 144 is expelled through the narrow neck 280 of the funnel element 270, fluid will rapidly release from the funnel element 270 into the fluid release sub 220. As discussed with reference to jar 100, the rapid release of fluid will cause a dynamic event in the wellbore 20. The dynamic event is characterized by the powerful jarring or jolting of the drill string 14 or bottom hole assembly 22 to dislodge the drill string 14 or bottom hole assembly 22 from its stuck point within the wellbore 20. This process may be repeated as many times as needed until the drill string 14 or bottom hole assembly 22 is dislodged from its stuck point within the wellbore 20.

Fluid released into the fluid passage 256 of the fluid release sub 220 may pass through the fluid vents 286 and back into the drill string 14. The fluid vents 286 are tear-shaped. The tear-shape allows fluid to pass through the vents 286, but not the deformed balls 144. The tear-shape also prevents deformed balls 144 from getting lodged within the vents 286 and blocking the flow of fluid. The deformed balls 144 may only pass from the funnel element 270 into the fluid release sub 220 and into the receiver sub 222. Fluid that is passed back into the drill string 14 from the vents 286 may flow around the outer surface of the receiver sub 222 and continue through the drill string 14, as shown in FIGS. 14-16.

Turning now to FIGS. 24-26, the jar 300 for use with the coiled tubing system 26 (FIG. 2) is shown in more detail. The jar 300 comprises a funnel element 302 and a collar element 304. The collar element 304 has a cylindrical outer body 306 that opens at a first end 308 and an opposite second end 310. The first end 308 of the collar element 304 attaches to the end of a coiled tubing drill string 30. The first end 308 of the collar element 304 may be welded onto the end of a coiled tubing drill string 30. Alternatively, a set of slips may be used to grip and hold the coiled tubing 30 and the first end 308 together.

The second end 310 of the collar element 304 has a set of external threads 312. The external threads 312 may thread onto internal threads (not shown) formed in a bottom hole assembly 36 used in coiled tubing operations 26. The collar element 304 is attached to the coiled tubing drill string 30 and bottom hole assembly 36 prior to starting coiled tubing drilling operations 26.

If the coiled tubing drill string 30 or bottom hole assembly 36 becomes stuck within the wellbore 20 during operations, the jar 300 may be assembled. To assemble the jar 300, the funnel element 302 is first lowered or pumped down the coiled tubing drill string 30. The funnel element 302 has an elongated tapered outer surface 314. The funnel element 302 may fit within the collar element 304 by entering the first end 308 of the collar element 304. The collar element 304 is configured to hold the funnel element 302 in place within the coiled tubing string 30.

To pump the funnel element 302 down the coiled tubing drill string 30, the funnel element 302 may be inserted into an end 31 of the coiled tubing drill string 30 at the ground surface 18 (FIG. 2). The funnel element 302 may be pumped through the entire spool 28 of coiled tubing 30 on the reel 32 at the ground surface 18 until the funnel element 302 enters the coiled tubing drill string 30 within the wellbore 20. The funnel element 302 will be pumped down the drill string 30 in the wellbore 20 until the funnel element 302 reaches the collar element 304. The funnel element 302 may also be incorporated into the collar element 304 prior to starting drilling operations.

Turning now to FIGS. 25-26, the jar 300 is shown in more detail. FIG. 25 is a perspective view of the funnel element 302 installed within the collar element 304. Portions of the funnel element 302 and the collar element 304 have been cut away, for better display. FIG. 25 is a cross-sectional view of the funnel element 302 within the collar element 304. The cross-section is taken along line H-H shown in FIG. 24. The collar element 304 has an internal midpoint 316. A shelf 318 (FIG. 25) is formed around the internal circumference of the collar element 304 at the midpoint 316. The coiled tubing drill string 30 enters the first end 308 of the collar element 304 and engages with the shelf 318. Below the midpoint 316 starts a centrally disposed collar passage 320. The collar passage 320 opens at a first surface 322 within the collar element 304 and at the second end 310 of the collar element 304. The first surface 322 opens at an annular shoulder 324 that tapers inwardly. The annular shoulder 324 connects to a neck 326 that opens at the second end 310 of the collar element 304.

The funnel element 302 will pass through the collar element 304 until it reaches the midpoint 316. When the funnel element 302 reaches the midpoint 316 the tapered outer surface 314 of the funnel element 302 will engage with the annular shoulder 324 of the collar passage 320. As the funnel element 302 moves down the collar passage 320 it will become lodged within the collar passage 320. This occurs because the upper portion of the funnel element 302 has a greater diameter than the neck 326 of the collar passage 320. Hydraulic pressure within the coiled tubing drill string 30 will keep the funnel element 302 lodged within the collar passage 320 during operation.

Like the jar 100 and 200, the funnel element 302 of the jar 300 has an internal fluid passage 328 that opens at a first surface 330 and an opposite second surface 332. The first surface 330 opens into an enlarged and recessed bowl 334. The bowl 334 tapers inwardly and connects with a narrow neck 336 that opens at the second end 332 of the funnel element 302. The bowl 334 has the shape of a frustum of a right circular cone having a slant angle of between 15 and about 20 degrees. Preferably this angle is 17.5 degrees. The connection between the bowl 334 and the narrow neck 336 forms a seat 338.

Once the jar 300 is assembled, the jar 300 may be activated. Like the jar 100 and 200, the jar 300 is activated by pumping a deformable ball 142 down the drill string 30. The same balls 142, 144 and operation described with reference to jars 100 and 200 may be used with the jar 300. The ball 142 is stopped once it reaches the seat 338 formed in the funnel element 302. The ball 142 prevents fluid from passing from the funnel element 302 into the collar passage 320 of the collar element 304. Hydraulic pressure builds on the ball 142 until it exceeds the pressure the ball can withstand. Once the pressure the ball 142 can withstand is exceeded, the ball will deform and be expelled through the narrow neck 336 of the funnel element 302. The deformed ball 144 will pass through collar passage 320 of the collar element 304 and may be retained within the bottom hole assembly 36. A screen (not shown) may be incorporated into the bottom hole assembly 36 to retain the deformed balls 144 but allow fluid to pass through. Alternatively, the deformed ball 144 may be expelled through the bottom hole assembly 36 and into the wellbore 20.

As the deformed ball 144 is expelled through the narrow neck 336 of the funnel element 302, fluid will rapidly release from the funnel element 302 into the collar passage 320 of the collar element 304 and into the bottom hole assembly 36. As discussed with reference to jar 100 and 200, the rapid release of fluid will cause a dynamic event in the wellbore 20. The dynamic event is characterized by the powerful jarring or jolting of the coiled tubing drill string 30 or bottom hole assembly 36 to dislodge the drill string 30 or bottom hole assembly 36 from its stuck point within the wellbore 20. This process may be repeated as many times as needed until the coiled tubing drill string 30 or bottom hole assembly 36 is dislodged from its stuck point within the wellbore 20.

The jars 100, 200, and 300 may be made of steel, aluminum, plastic, carbon fiber or other materials suitable for use in oil and gas operations. Preferably the jars 100, 200, and 300 are made of steel. The jars 100, 200, and 300 may also be covered in tungsten nitrate to harden the outer surface and help prevent the jars from rusting over time Loctite may also be used on the threads on jars 100, 200, and 300. The Loctite helps secure the threaded connections to prevent the jars 100, 200, and 300 from becoming unthreaded during operation. Each of the jars 100, 200, and 300 may be easily disassembled and contained within a handheld carrying case.

A jar 100, 200, 300 may be assembled from a kit. Such a kit should include at least one funnel element 122, 270, 302, and at least one, and preferably a plurality of deformable balls 142. In some embodiments, the kit may further include at least one collar element 304.

In other embodiments, the funnel element 122, 270 of the kit may be incorporated into a funnel sub 102, 218 and the kit may further include a receiver sub 104, 222. Such a kit may also include at least one fluid release sub 220.

Although the preferred embodiment has been described in detail, it should be understood that various changes, substitutions and alterations can be made therein without departing from the spirit and scope of the invention as defined by the appended claims.

The invention claimed is:

1. A method of using a kit, the kit comprising:

a funnel element having opposed first and second surfaces and one and only one through-bore, the through-bore being a fluid passage that joins the first and second surfaces and has an enlarged and recessed bowl that opens at the first surface and connects with a narrow neck that opens at the opposite second surface;

a collar element configured for incorporation into an elongate tubular string having an upstream end and a downstream end; in which the collar element has a centrally disposed collar passage configured to receive the funnel element; and at least one deformable ball, each of which is sized, in its undeformed state, to be seated within the bowl;

in which the collar element has been incorporated into an elongate tubular string and the funnel element is positioned outside of the collar element;

the method comprising:

lowering the funnel element into the collar element.

2. The method of claim 1, in which the funnel element is lowered into the collar element on a wireline within the tubular string.

3. The method of claim 1, in which the funnel element is lowered into the collar element by fluid pumped into the tubular string.

4. The method of claim 1, further comprising:

lowering one of the deformable balls into a seated position within the recessed bowl; and increasing fluid pressure within the tubular string until the deformable ball is deformed and expelled through the narrow neck of the funnel element.

5. The method of claim 4 further comprising:

releasing pressurized fluid rapidly through the narrow neck of the funnel element; and jarring the tubular string as the ball is expelled through the narrow neck of the funnel element.

6. The method of claim 1 in which the collar passage has a tapered shape.

7. The method of claim 1 in which the collar passage has an annular shoulder engageable with the funnel element.

8. The method of claim 1, in which the elongate tubular string is coiled tubing.

9. The method of claim 1, in which the funnel element is lowered into the collar element by fluid pumped into the tubular string.

10. The method of claim 1, in which the kit is used with a system, the system comprising:

a wellbore formed within the ground and having a casing installed therein;

in which the tubular string has no opening between its ends and has a first portion situated within the casing and a second portion wound around an above-ground reel; and in which the at least one deformable ball is situated outside of the tubular string.

11. The method of claim 10, in which the step of lowering the funnel element into the collar element comprises:

installing the funnel element into the second portion of the tubular string;

flowing fluid into the second portion of the tubular string such that the fluid carries the funnel element from the second portion to the first portion of the tubular string; and lowering the funnel element down the first portion of the tubular string and into a stationary position within the collar element.

12. A jarring tool, comprising:

a collar element configured for incorporation into an elongate tubular string, the tubular string having an upstream end and a downstream end; in which the collar element has a centrally disposed collar passage; and a funnel element installed within the collar element and having opposed first and second surfaces joined by a fluid passage, the fluid passage having an enlarged and recessed bowl that opens at the first surface and connects with a narrow neck that opens at the opposite second surface; in which an outer surface of the funnel element is tapered;

in which the funnel element is lodged within the collar passage upon engagement of the tapered outer surface of the funnel element with a wall or walls surrounding the collar passage; and in which the funnel element is configured to receive at least one deformable ball.

13. The jarring tool of claim 12, in which the collar element has opposed first and second surfaces; in which an opening of the collar passage is disposed intermediate the first and second surfaces; and in which the recessed bowl is positioned upstream from the opening of the collar passage when the funnel element is lodged within the collar passage.

14. The jarring tool of claim 12, in which the outer surface of the funnel element tapers inwardly from the first surface to the second surface.

15. The jarring tool of claim 12, in which the jarring tool is configured so that only the at least one deformable ball moves in order to activate operation of the tool.

16. A jarring tool, comprising:

a collar element configured for incorporation into an elongate tubular string having an upstream end and a downstream end; in which the collar element has a centrally disposed collar passage; and a funnel element installed within the collar element and having opposed first and second surfaces joined by a fluid passage, the fluid passage having an enlarged and recessed bowl that opens at the first surface and connects with a narrow neck that opens at the opposite second surface;

in which the funnel element is configured to receive at least one deformable ball; and in which the jarring tool is configured so that only the at least one deformable ball moves in order to activate operation of the tool.

17. The jarring tool of claim 16, in which the collar element has opposed first and second surfaces; in which an opening of the collar passage is disposed intermediate the first and second surfaces; and in which the recessed bowl is positioned upstream from the opening of the collar passage.

18. The jarring tool of claim 16, in which the collar passage is sized to prevent downstream movement of the funnel element within the collar element.

* * * * *